US006116666A

United States Patent [19]

Adamson et al.

[11] Patent Number: 6,116,666

[45] Date of Patent: Sep. 12, 2000

[54] TAMPER-EVIDENT LOCKING DEVICE

[75] Inventors: Donald Adamson, Wallingham; Arthur Benjamins, Sidcup, both of United Kingdom

[73] Assignee: Envopak Group Limited, Kent, United Kingdom

[21] Appl. No.: 09/269,886

[22] PCT Filed: Oct. 17, 1997

[86] PCT No.: PCT/GB97/02861

§ 371 Date: Apr. 2, 1999

§ 102(e) Date: Apr. 2, 1999

[87] PCT Pub. No.: WO98/18112

PCT Pub. Date: Apr. 30, 1998

[30] Foreign Application Priority Data

Oct. 18, 1996 [GB] United Kingdom ..... 9621745

[51] Int. Cl.[7] ..... B65D 27/30

[52] U.S. Cl. ..... 292/307 R; 292/318; 24/543

[58] Field of Search ..... 292/307 R, 307 A, 292/316, 317, 318, 319, 320, 321, 322; 24/543, 3.4

[56] References Cited

U.S. PATENT DOCUMENTS

| | | | |
|---|---|---|---|
| 3,461,876 | 8/1969 | Miller, Jr. | 24/543 |
| 3,724,890 | 4/1973 | Adamson et al. | 292/322 |
| 3,729,780 | 5/1973 | White | 24/156 |
| 4,071,930 | 2/1978 | Tanaka | 24/252 R |
| 4,531,670 | 7/1985 | Kupersmit | 229/45 R |
| 4,762,296 | 8/1988 | Kraus et al. | 248/74.2 |
| 4,793,641 | 12/1988 | Sokol | 292/322 |
| 5,022,126 | 6/1991 | Davis | 24/543 |
| 5,305,500 | 4/1994 | Tucker | 24/30.5 R |
| 5,337,987 | 8/1994 | Sawatsky | 248/231.8 |
| 5,363,539 | 11/1994 | Tisol | 24/543 |
| 5,522,627 | 6/1996 | Swift | 292/319 |
| 5,568,952 | 10/1996 | Ruegg | 292/318 |
| 5,660,505 | 8/1997 | Emory, III | 405/258 |
| 5,735,022 | 4/1998 | Niedecker | 24/30.5 R |

FOREIGN PATENT DOCUMENTS

| | | | |
|---|---|---|---|
| 1085107 | 6/1953 | France | 70/14 |
| 17 61 379 | 6/1971 | Germany . | |
| WO 94/05558 | 3/1994 | WIPO . | |

*Primary Examiner*—B. Dayoan
*Assistant Examiner*—Clifford B Vaterlaus
*Attorney, Agent, or Firm*—McDermott, Will & Emery

[57] ABSTRACT

The lockable tamper-evident device is suitable for securing a closure member in its closed position to an article. The device comprises a pair of arms (1,1') which are movable between an open position in which the arms (1,1') are engagable with an article and/or a closure member, and a locked-closed position in which disengagement of the arms from the article and/or the closure member is prevented by engagement of a cooperable locking means.

Preferably, the arms (1,1') are engagable with a projection 7,7' extending either from the article and through an opening in the closure member or from the closure member and through an opening in the article.

Preferably, the cooperable locking means (8,10,11,12) is carried by the arms (1,1'), activation of the locking means (8,10,11,12) being brought about by movement of the arms (1,1') to the locked-closed position. In the locked-closed position removal of the closure member is prevented by engagement of the arms (1,1') with the article and/or the closure member.

7 Claims, 3 Drawing Sheets

TAMPER-EVIDENT LOCKING DEVICE

This invention relates to a locking device and in particular to a lockable, tamper-evident device for securing a closure member in its closed position to an article.

Conventionally, locking devices necessitate the use of a tool, for example a key, for locking and/or unlocking purposes. With such locks unauthorised opening and subsequent locking is not always evident and potential duplication of the tool provides an additional security risk. Further problems associated with these locks would be apparent to the skilled person and include: accidental loss of the key necessitating breakage of the lock; the wear and tear of the engagable and movable parts of the lock and key; and the expense and maintenance of the lock.

U.S. Pat. No. 5,522,627 discloses a reusable security seal. The seal comprises a pair of hingedly-mounted arms having co-operable locking means located at the free ends of the arms. Locking of the seal is effected by hinged movement of the arms towards each other and engagement of the co-operable locking means.

DE-A-1761379 discloses a seal which is operable in a similar manner to the one disclosed in U.S. Pat. No. 5,522,627. However, in this case each of the hingedly-mounted arms has a recess which, when the device is in the locked-closed position, cooperate to trap and retain a cord or ribbon.

The present invention overcomes the above problems by providing a cheap to produce and reliable, lockable device for which no separate tool is required for locking and/or unlocking purposes. The device provides a self-evident means for identifying when a closure member for an article has been tampered with in order to gain access to the article. Once the device is in a locked-closed position it is only removable by means which result in physical damage to the device which in turn provides evidence of tamper. Furthermore, once the device has assumed the locked-closed position it is not re-usable. Thus, it may be more appropriate to refer to the lockable device as a security seal. Each seal is uniquely identifiable, for example, by a bar code or serial number or by other means which would be apparent to the skilled person. Accordingly, any attempted replacement of a broken seal with a new seal would be evident by comparison of the respective device identification means.

The present invention provides a lockable tamper-evident device for securing a closure member in its closed position to an article, comprising a pair of arms mounted by a hinge to each other which arms are movable along a defined radial path relative to the hinge between an open position wherein the free ends of the arms remote from the hinge are spaced apart from each other thereby permitting respective outwardly-facing portions of the arms to engage with the article and/or closure member, and a locked-closed position in which disengagement of the arms from the article and/or the closure member is prevented by engagement of a co-operable locking means carried by the arms, activation of the locking means being brought about by radial movement of the arms towards each other and into the locked-closed position, and when in the locked-closed position removal of the closure member being prevented by engagement of the arms with the article and/or the closure member.

In one embodiment of the present invention, the arms are engagable with a projection extending either from the article and through an opening in the closure member or from the closure member and through an opening in the article. In the latter embodiment, the projection may extend through an opening provided in an outwardly facing part of the article.

The projection and the arms are adapted to engage with each other. In a preferred embodiment, the arms form a socket in the locked-closed position which is engagable with a ball located at the free end of the projection. Alternatively, the arms may carry inwardly facing edges which, in the locked-closed position, grip corresponding grooves located on the projection. Preferably, the projection and the corresponding opening are of non-circular cross section to minimise potential rotation of the closure member about the projection. The present invention includes further means for engagement of the arms and the projection which would be apparent to the skilled person.

Preferably the arms are simultaneously engagable, when in the open position, with two projections and when in the locked-closed position the cooperable locking means prevents disengagement of the arms from the two projections.

In a preferred embodiment, each arm carries an outwardly extending portion, and when the arms are in the locked-closed position, the outwardly extending portions protrude in substantially opposite directions, and when the arms are in the open position, said portions are engagable with corresponding orifices located on facing surfaces of the two projections. In a more preferred embodiment, the two projections have a pair of holes located in facing surfaces for engagement with the outwardly extending portions of the arms.

In one embodiment the arms are hingeable and the outwardly extending portions protrude from the outer surface of each arm which is remote from the hinge. In a more preferred embodiment, the arms are hingeable end-to-end and the outwardly extending portions are located in close proximity to the hingeable ends of the arms. In the latter embodiment, the distance between the respective free ends of the outwardly extending portions is greater in the locked-closed position than it is in the open position. This is achievable by way of the hingeable arrangement of the arms which is described below. In the locked-closed position, the arms are substantially parallel to each other and the internal angle formed by the arms and the hinge is substantially zero. As the internal angle is increased by hinged movement of the arms, the free ends of the outwardly extending portions follow a defined radial path relative to the hinge. At a given internal angle, the free ends of the outwardly extending portions will be diametrically opposite each other at which point the distance between the free ends is a maximum. Further hinged movement increases the internal angle and simultaneously reduces the distance between the respective free ends of the arms until the arms reach the open position in which they are engagable with the two projections. In principle, the maximum internal angle between the arms is limited by abutment of the hingeable ends of the arms with each other. However, the maximum internal angle is generally restricted to less than 180° by cooperation of an abutment shoulder extending from the hingeable end of one arm with the hingeable end of the other arm. Restriction of the internal angle reduces undesirable stress on the hinge.

One or both of the two projections may be slidably mountable to the article and/or the closure member. In this embodiment the outwardly extending portions are barbed so that, following engagement of the outwardly extending portions with the two projections, inadvertent disengagement of an outwardly extending portion from its projection does not occur as a result of slidable movement of the projection/s. An advantage of this embodiment is that the barbed portions automatically provide a tightening of the device and the article and/or the closure member during actuation of the arms from the open position to the locked-closed position by a relative drawing together of the two projections.

According to a preferred embodiment of the present invention, one of the arms of the device has a line of weakness located between the locking means and the point of engagement of the arm with the projection, said line of weakness providing convenient means for removal of the device. Simple manual force, for example fingers acting directly on the arm, is sufficient to break the arm and release the seal.

In one embodiment, the device is simultaneously engagable with a projection extending from the closure member and with a projection extending from the article. In this embodiment, the closure member is preferably mountable to the article at a position away from the point of engagement of the device and the two projections.

Reference is now made to the accompanying drawings without any limitation thereto being intended.

Figure 1:
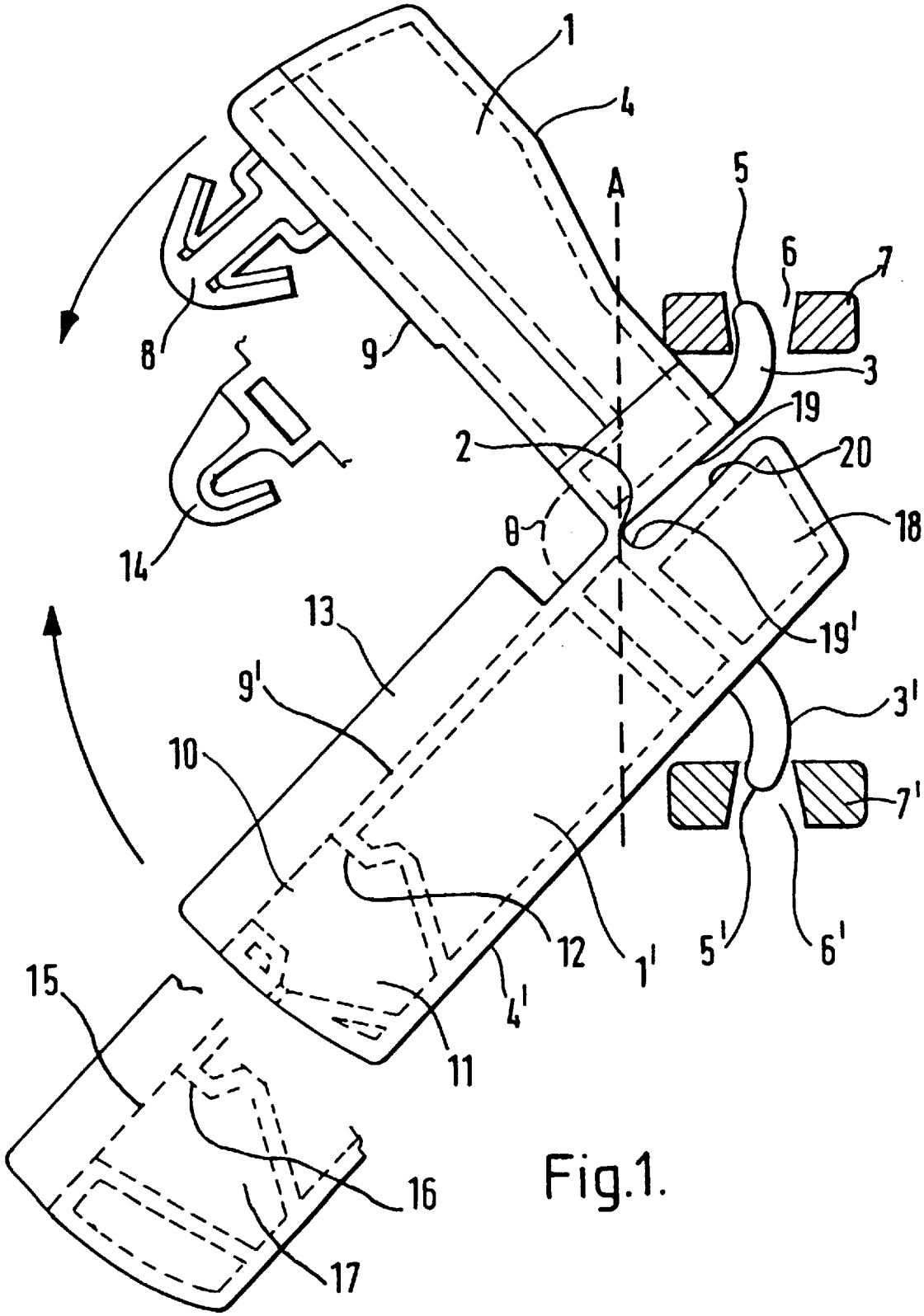
FIG. 1 illustrates a plan view of one embodiment of the device according to the present invention in which the arms are in the open position and in which the arms are engagable with two projections.

Referring to FIG. 1, a pair of arms 1,1' are mounted end-to-end by a hinge 2. The arms and hinge are formed as an integral plastics mounding. Each arm 1,1' carries a curved outwardly extending portion 3,3' located on the outer surface 4,4' of each arm 1,1' which is remote from the hinge 2. The arms 1,1' are movable along a defined radial path relative to the hinge 2. At a given position, identified by the line A, the free ends 5,5' of the curved portions 3,3' are diametrically opposite each other. In this position, the distance between the respective free ends 5,5' is a maximum. Any further increase of the internal angle, $\phi$, formed by the arms 1,1' and the hinge 2, reduces the distance between the respective free ends 5,5' of the curved portions 3,3' until an open position is achieved in which the curved portions 3,3' are engagable with a pair of openings 6,6' located in facing surfaces of a pair of corresponding projections 7,7' forming part of the article (not shown) to be secured. The projections 7,7' are of rectangular cross-section and extend through corresponding rectangular slots provided in the closure member (not shown). Only the free ends of the projections 7,7' are illustrated.

A resiliently yieldable arrow-head formation 8 is located on the inside surface 9 of the arm 1. Hinged actuation of the arms 1,1' (in the direction of the arrows) towards each other permits sliding insertion of the arrow-head formation 8 through a reduced diameter mouth 10 located on the facing inside surface 9' of the arm 1' and into a corresponding socket 11 located within the arm 1'. The reduced diameter mouth 10 defines an inwardly facing abutment shoulder 12. Following insertion of the arrow-head formation 8 into the socket 11, retraction of the arrow-head formation 8 is prevented by abutment of the arrow-head formation 8 with the shoulder 12 of the reduced diameter mouth 10. This represents the closed-locked position of the arms 1,1'.

During actuation of the arms 1,1' from the open position to the closed-locked position, the curved portions 3,3' tend to pull the projections 7,7' together thereby tightening the lockable assembly.

The arm 1' carries a protective flange 13 along both opposite side surfaces (not shown) of the arm 1' (only one is shown). During actuation of the arms 1,1' to the locked-closed position, the flanges 13 slide over the corresponding opposite side surfaces (not shown) of the arm 1 and protect the arrow-head formation 8, the reduced diameter mouth 10, the abutment shoulder 12 and the socket 11 from tamper.

FIG. 1 also illustrates a single barb variant 14 which is inter-changeable with the arrow-head formation 8 on arm 1. Following actuation of the arms 1,1' from the open position to the locked-closed position the single barb 14 is slidingly inserted into, though not retractable from the corresponding reduced diameter mouth 15 located on the inside surface 9' of the arm 1'. The abutment shoulder 16 and the socket 17 function as described above for the shoulder 12 and the socket 11 respectively.

An extension 18 of the hinged end 19' of the arm 1' provides an abutment surface 20. The surface 20 prevents excess hinged movement of the arms 1,1' by abutment of the hinged end 19 of the arm 1 with the surface 20.

Figure 2:
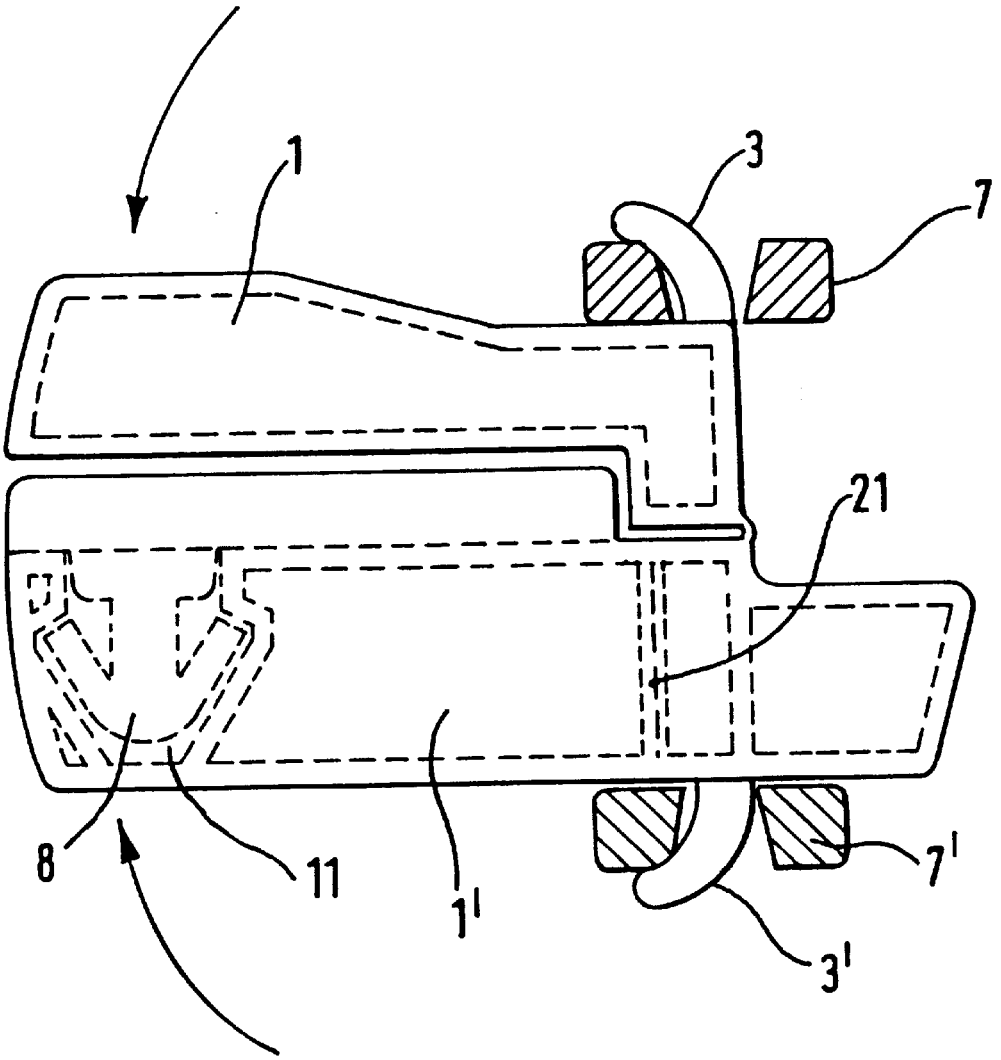
FIG. 2 illustrates a plan view of the device as shown in FIG. 1 in which the arms are in the locked-closed position.

Referring to FIG. 2, the arms 1,1' are in the locked-closed position. The barbed portions 3,3' are engaged with the projections 7,7' and the arrow-head formation 8 is non-retractably inserted into the socket 11 located in the arm 1'. A line of weakness 21 is located across the arm 1' between the barbed portion 3' and the socket 12.

Figure 3:
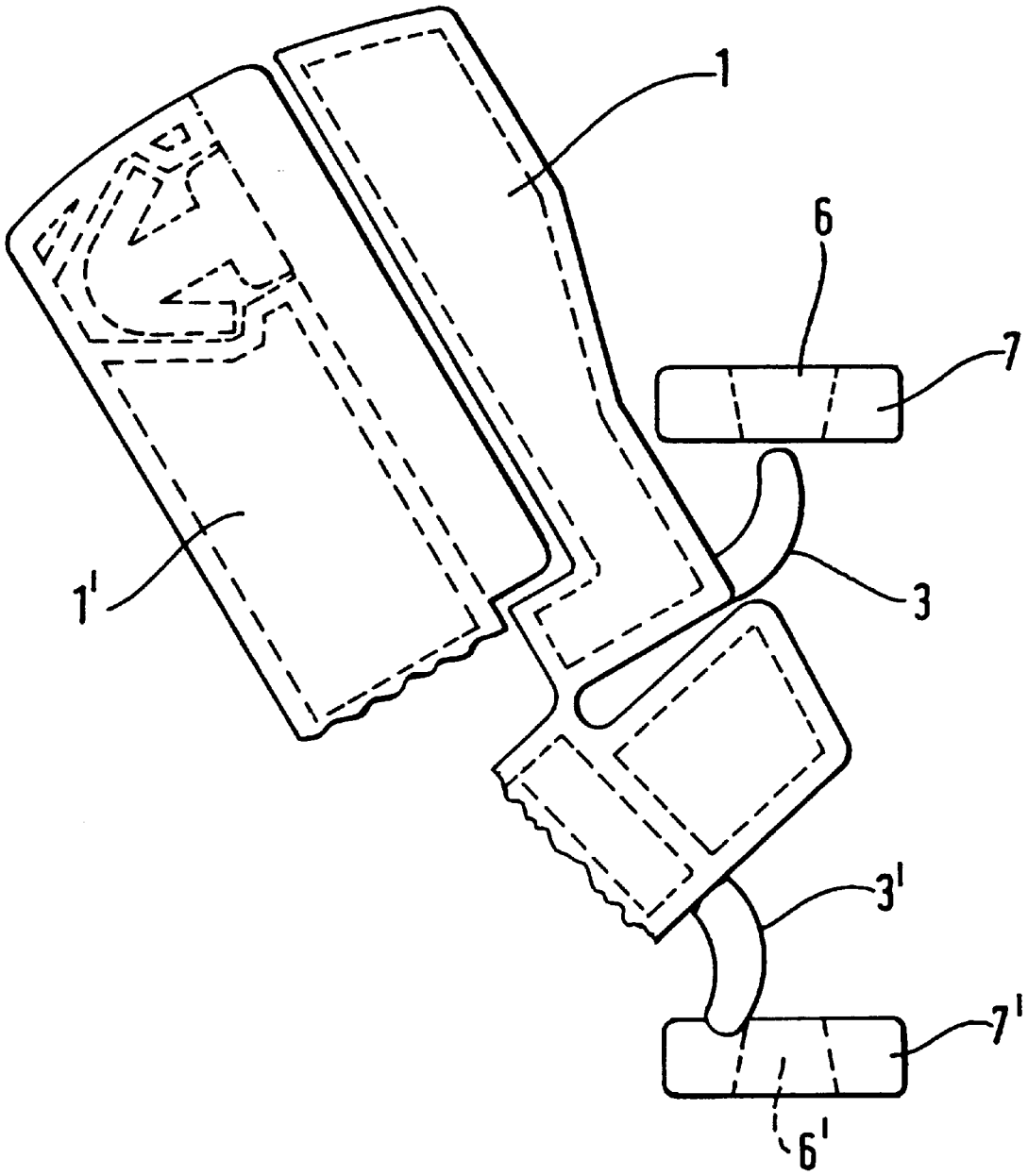
FIG. 3 illustrates a plan view of the device as shown in FIG. 2 in which one of the arms has been broken along a line of weakness to allow removal of the device.

Referring to FIG. 3, the arm 1' has been broken along the line of weakness 21, thereby allowing the barbed portions 3,3' to hinge towards each other to an open position in which they are releasable from the openings 6,6' of the projections 7,7'. The illustrated device is now broken, unusable and provides evidence of tamper. In practice, the device is only intended to be broken by authorised personnel.

What is claimed is:

1. A lockable tamper-evident device for securing a closure member in its closed position, comprising a pair of arms hingedly linked to each other at respective proximal ends, so as to permit movement of one arm relative to the other through an arc between an open position, in which distal ends of the arms are spaced apart, and a closed position, in which the distal arm ends abut each other, each arm having an abutting surface and an opposite non-abutting surface, wherein the respective abutting surfaces abut each other in the closed position, and each non-abutting surface having a hook for engagement with the closure member to be secured, the spacing apart of the hooks becoming greater during movement from the open position to the closed position, and the abutting surface of one arm having a plug and the abutting surface of the other arm having a socket for receiving and non-detachable permanent locking of the plug in the closed position.

2. A device according to claim 1, wherein in the open position the arms are simultaneously engageable with two projections forming part of the closure member and wherein in the closed position disengagement of the arms from the two projections is prevented by the permanent locking of the plug in the socket.

3. A device according to claim 2, wherein, when the arms are in the closed position, the hooks protrude in substantially opposite directions, and when the arms are in the open position, said hooks are engageable with a pair of orifices located on facing surfaces of the two projections.

4. A device according to claim 3, wherein at least one of the hooks is curved such that, when in the closed position, the free end of the curve points away from the proximal end and generally towards the distal end of the respective arm.

5. A device according to claim 1 wherein one of the arms carries a line of weakness located between the plug or socket and the hook, said line of weakness providing means for easy release of the device by authorized personnel.

6. A device according to claim 1, wherein in the closed position the plug and socket are externally inaccessible.

7. A device according to claim 1, wherein in the locked-closed position the co-operable locking means is externally inaccessible.

* * * * *